US005182607A

United States Patent [19]

Braswell et al.

[11] Patent Number: 5,182,607

[45] Date of Patent: Jan. 26, 1993

[54] HIGH-VOLUME DUPLICATOR SYSTEM AND METHOD PROVIDING EFFICIENT TOWER AND DUPLICATOR OPERATION AND FACILITATED UNLOADING IN THE COLLATED DUPLEX MODE

[76] Inventors: Charles D. Braswell, 72 Churchhill Rd., Henrietta, N.Y. 14467; Robert E. Carley, 81 Foxbourne Rd., Penfield, N.Y. 14526; Riley L. Warddrip, 37 Muirfield Crt., Pittsford, N.Y. 14534

[21] Appl. No.: 744,162

[22] Filed: Aug. 13, 1991

[51] Int. Cl.[5] ..... G93G 21/00

[52] U.S. Cl. ..... 355/323; 271/290; 271/298; 355/313

[58] Field of Search ..... 271/290, 289, 298; 355/308, 309, 313, 321, 322, 323

[56] References Cited

U.S. PATENT DOCUMENTS

| | | | |
|---|---|---|---|
| 3,395,913 | 8/1968 | Del Vecchio et al. | 271/64 |
| 3,709,480 | 1/1973 | Schulze et al. | 270/58 |
| 3,870,295 | 3/1975 | Kukucka | 271/173 |
| 4,086,658 | 4/1978 | Finlay | 364/900 |
| 4,405,225 | 9/1983 | Perrault | 355/323 |
| 4,522,486 | 6/1985 | Clark et al. | 270/58 |
| 4,872,662 | 10/1989 | Ishikawa et al. | 271/290 |
| 4,934,681 | 6/1990 | Holmes et al. | 271/3 |
| 4,974,034 | 11/1990 | Rabb et al. | 355/319 |

*Primary Examiner*—A. T. Grimley
*Assistant Examiner*—P. Stanziong
*Attorney, Agent, or Firm*—Finnegan, Henderson, Farabow, Garrett & Dunner

[57] ABSTRACT

A copy system has a duplicator with a limited capacity duplex tray and a high-volume sorter that has 10 towers with 60 bins in each tower. Transport and directing mechanisms are operated to distribute copies to the various bins. A microprocessor control system operates the duplicator and the sorter. The control determines how many bins are to receive each collated set in the collated duplex mode of operation. The towers are operated in a single tower loading mode if the number of bins for each collated set is one. On the other hand, the towers are operated in a multiple tower loading mode if the number of sets for each collated set is greater than one.

11 Claims, 14 Drawing Sheets

HIGH-VOLUME DUPLICATOR SYSTEM AND METHOD PROVIDING EFFICIENT TOWER AND DUPLICATOR OPERATION AND FACILITATED UNLOADING IN THE COLLATED DUPLEX MODE

CROSS-REFERENCE TO RELATED APPLICATIONS

Reference is made to the following related patent applications filed concurrently herewith and assigned to the present assignee:

Ser. No. (744,131) entitled HIGH-VOLUME DUPLICATOR PROVIDING EFFECTIVE SEPARATION OF COPY STACKS by Charles D. Braswell.

Ser. No. (744,103) entitled HIGH-VOLUME DUPLICATOR SYSTEM AND METHOD PROVIDING EFFICIENT SYSTEM OPERATION IN THE COLLATED SIMPLEX LIMITLESS MODE, by Charles D. Braswell and Riley L. Warddrip.

Ser. No. (744,104) entitled HIGH-VOLUME DUPLICATOR HAVING EFFICIENT OPERATION IN THE UNCOLLATED DUPLEX MODE by Charles D. Braswell.

Ser. No. (744,034), UNLIMITED DOCUMENT FEEDER, by Charles D. Braswell.

BACKGROUND OF THE INVENTION

The present invention relates to high-volume reproduction systems and methods and more particularly to duplicator systems and methods structured for efficient high-volume reproduction in the collated duplex mode.

There are a variety of commercial applications of reproduction technology where a need exists to reproduce manuals or books, or sets thereof, containing up to thousands of pages that are suitably assembled such as in three-ring binders or in bound units. A large number of book copies may be required for distribution to users or customers. Applications like these are called high-volume applications.

In particular high-volume applications, the books may have to be revised or updated periodically, such as every three or six months. In the revision process, some but normally not all pages will be modified and some pages may be deleted or added. In many cases, trade practices or regulatory requirements may make it necessary to reproduce the entire revised book or set of books as opposed to reproducing insert pages for appropriate placement in the original book copies. In any case, the page insert approach is typically undesirable because it is labor intensive and because of the likelihood of assembly errors.

The original text, graphics, and photographs, that constitute the book content, may reside in multiple sources. For example, an original may reside on microfilm, in electronic storage, on standard 8½"×11" paper, or on "paste-ups". Originals from which reproductions are to be made are derived from the multiple storage sources and placed on one or more selected media.

A typical commercial application in which high-volume reproduction technology is needed is that in which a manufacturer makes and sells relatively complex products for which maintenance books must be issued and revised from time to time. The production of maintenance books for a product which may be supplied in a variety of forms or models typically is relatively complex because of book differences that are required for different models and/or customers.

Offset lithography is one process that has often been used for high-volume reproduction, but it is typically relatively expensive. In this process, extensive setup time is required for building each master original or revised original. Relatively high pressman labor operating costs are incurred, and up to 10% of the total copy output constitutes waste copies caused by process adjustment during job startup and shutdown. It is noteworthy, however, that offset lithography does in general provide high resolution production of photographic originals.

Large output sorters, having multiple towers containing up to 600 or more bins, have been employed in offset lithography to support post-collation book production for high-volume jobs. However, the operation of such sorters and the lithography production process as a whole has been relatively inflexible especially in terms of accommodating more complex jobs that involve varying production requirements within a particular job or from job to job. Such inflexibility stems from the very nature of the whole lithographic reproduction and sorting process along with an absence of process controls that, if implementable at all, could otherwise facilitate the creation of added process flexibility.

In high-volume jobs that require "limitless" sorting, that is, a number of copies greater than the machine reproduction capacity, typically the operator of the lithography process must determine the job breakup and run the job parts accordingly. Another example of relative inflexibility in the offset lithography process is that in which some book copies may require certain pages to be different from corresponding pages in other book copies. While the lithography process may be operated to permit collation of the proper page copies in the various book copies, such process operation is highly inefficient, costly and inconvenient.

An additional example of flexibility limits in the offset lithography process is that in which a capability is needed for job parking at the end of work shifts. A job is parked when work is left in sorter bins at the end of a shift and the job is picked up again on the next shift, often the next day. The lithography pressman has limited system hardware support in resuming the parked job and completing it.

Pre-collation copying with use of a duplicator is another process that has been used for reproducing multiple copies of original manuals or books. However, the machine capacity limits successive segment sizes which therefore must be "hand-married" or manually collated after production. Copy integrity is also a problem in the pre-collation reproduction process. Thus, an occasional skewing of an original document on the platen glass requires inspection of all output copies to uncover any skewed ones and thereby assure copy product quality. Such inspection is impractical for high-volume jobs.

Another process that lends itself to high-volume reproduction is a process in which post-collation copying is performed with use of a duplicator and a high capacity sorter. Generally, the availability of electronic control with a duplicator provides a basic capability for creating process flexibility in high-volume reproduction jobs.

As compared to a pre-collation duplicator process, a post-collation duplicator process facilitates the performance of highly complex jobs because the layout of collation bins allows for the tailoring of some book copies to meet the requirements of particular customers or particular product models. Moreover, possible future commercial use of a common electronic format for source originals could be efficiently implemented in high-volume reproduction jobs with the use of electronically controlled duplicators.

High-volume, post-collation duplicators have been generally unavailable commercially because of a lack of required technology development.

More specifically, in a high-volume reproduction system, the sorter is structured with a plurality of multiple-bin towers thereby providing a high volume of bins for sorting. For example, the sorter may contain up to 600 or more bins with each bin having a maximum capacity of 100 sheets.

In the collated duplex mode, a large job has to be broken into job segments which are sized as a function of the duplex tray capacity, the requested copy quantity, the number of bins available and the number of bins allocated per output set. Multiple bins are required for an output set if the size of the set exceeds the sheet capacity of a single bin.

The duplex tray in a duplicator temporarily holds copy sheets during the duplex copying process and normally has a limited capacity, such as 100 sheets. Thus, the copy sheet capacity of the high-volume sorter bin is much greater than the number of copies that the duplex tray can deliver in a single pass. The manner in which copies are delivered to form collated sets in the sorter towers affects copy reliability and system and operator efficiency.

Copy reliability tends to increase as the number of copies made per placement of an original document increases, principally because the probability of a skewed placement of an original increases with increasing placements of originals. Further, sorting efficiency is enhanced through facilitated operator unloading if the sorter is loaded one tower at a time, since the operator unload process then progresses in a logical sequence especially when the system is executing the entry job in the limitless mode. In limitless operation, the operator unloads one job segment as another job segment is being delivered to the sorter, and this load-unload process continues until the job is completed.

In the illustrative case of a tower having 60 bins, a reasonable balance exists among copy reliability, system efficiency and operator unloading facility when copy distribution is scheduled as tower-by-tower loading with an allocation of a single bin for each set. In that case, the job segment size is 60 copies which provides a reasonable utilization of the duplex tray as well as the original document handler and opera unloading is facilitated since unloading of a job segment is simply achieved by unloading the single tower.

However, if more than one bin is used per set because of set size, duplex tray and automatic document handler utilization is reduced in a tower-by-tower load process. In the illustrative example of 60-bin towers, the number of bins per set may, for example, be 1, 2, 3, 4, 5, or 6. With copy distribution scheduled as tower-by-tower loading, duplex tray and automatic document handler utilization would be 60, 30, 20, 15, 12, and 10 copies, respectively. Thus, with the tower-by-tower scheduling, system efficiency, i.e. duplex tray and document handler utilization, decreases significantly with increasing set sizes that require increasing numbers of bins per set.

SUMMARY OF THE INVENTION

The present invention has been made in view of the above circumstances and has as an object to provide a duplicator and sorter capable of operation in the collated duplex mode so that copy production and distribution are scheduled to produce a reasonable balance in copy reliability, system operating efficiency and operator unloading facility essentially independently of the size of the entered job.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims To achieve the objects and in accordance with the purpose of the invention, as embodied and broadly described herein, the copy system of this invention comprises means for duplicating successive original documents, the duplicating means having a limited capacity duplex tray for supporting copy processing in the duplex mode, means for sorting output copies delivered from the duplicating means, the sorting means having a plurality of towers each of which has a plurality of bins, means for transporting output copies to each of the towers, means for directing output copies in each tower to each bin therein, and means for controlling the duplicating means and the transporting and directing means for the towers and the bins in the collated duplex mode, the controlling means including means for determining how many bins are to receive each collated set, the controlling means further including means for operating the towers in a single tower loading mode if the number of bins for each collated set is equal to or less than a predetermined number, and the controlling means additionally including means for operating the towers in a multiple tower loading mode if the number of bins for each collated set is greater than the predetermined number.

BRIEF DESCRIPTION OF THE DRAWINGS

The accompanying drawings, which are incorporated in and constitute a part of this specification illustrate one embodiment of the invention and together with the description provide an explanation of the objects, advantages and principles of the invention. In the drawings:

FIG. 5A1 portrays a functional block diagram of a control system for the duplicator of FIG. 2;

FIG. 5A2 shows a diagram of a programmed functional sequence employed in the duplicator control to start and stop sorter operation;

DESCRIPTION OF THE PREFERRED EMBODIMENT

Figure 1:
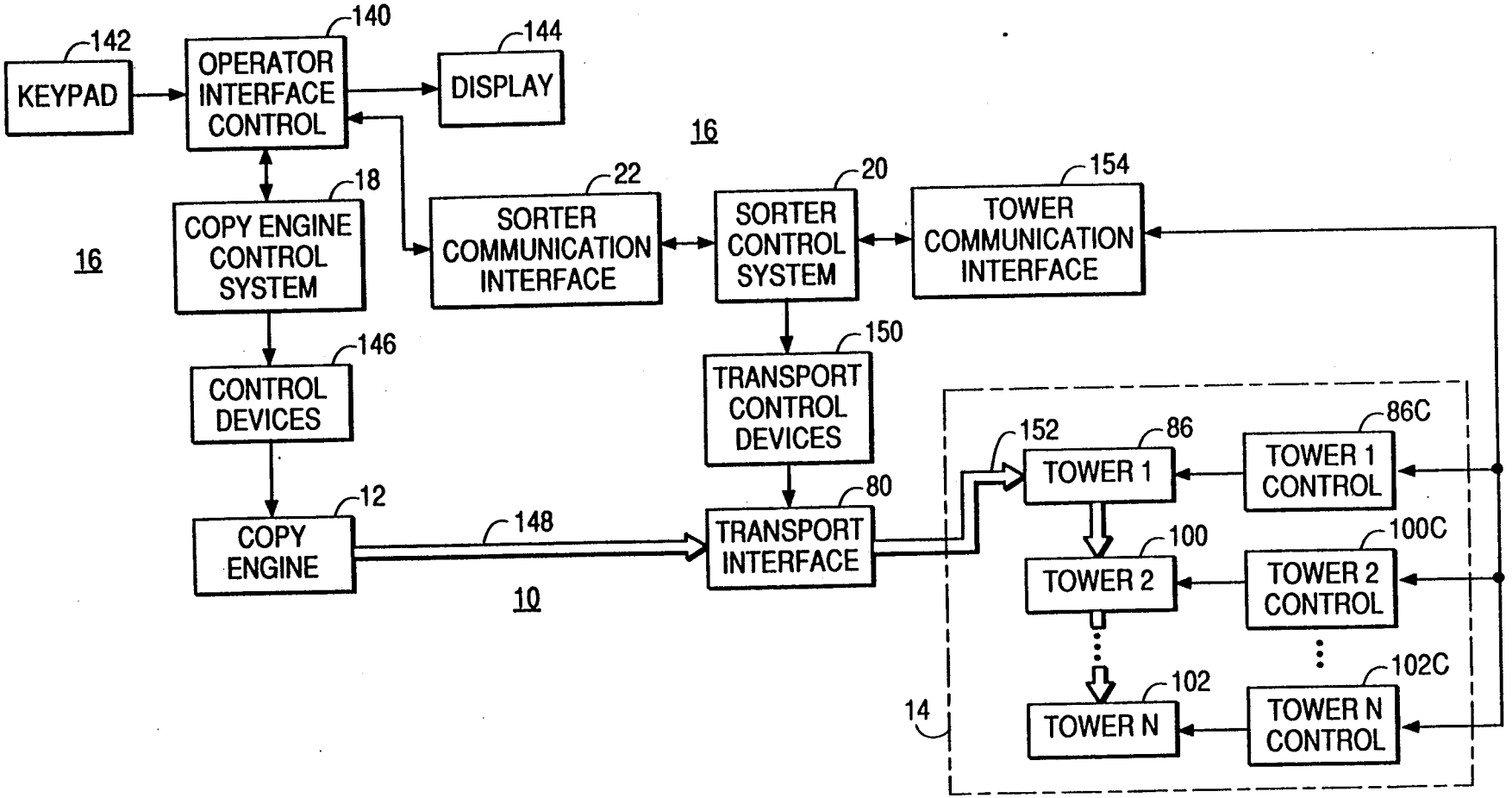
FIG. 1 is a block diagram of a copy system arranged in accordance with the principles of the present invention.

There is shown in FIG. 1 a copy system 10 having means for producing copies of original documents and means for sorting the copies for assembly into collated books or the like. The system 10 employs a copy engine 12 that in this preferred embodiment is in the form of a xerographic duplicator. Further, the system 10 employs a multi-tower sorter 14 that is coupled to the engine or duplicator 12 to receive copies as they are produced and direct them into tower bins as required for collated distribution assembly into books or manuals.

Generally, the copy system 10 is structured to meet the needs of customers who have high volume copying requirements. For example, in the commercial airline manufacturing industry, operation and maintenance manuals may contain thousands of pages and normally must be updated and reproduced frequently, such as every three months. An updated set of manuals may be issued to airline customers for each airliner in use.

The present invention is especially useful for application in copy systems designed for high copy-volume usage. In the preferred embodiment described herein, the copy system is provided in the form of a 9900/60+ xerographic duplicator manufactured by the Xerox Corporation.

The copy system 10 further includes a control system 16 that is structured to operate and control the copy system 10 in accordance with the principles of the invention. The control system 16 includes an engine control 18 for the duplicator 12 and a sorter control 20 for the multi-tower sorter 14. A sorter communications interface 22 links the controls 18 and 20 to provide coordinated control and operation of the duplicator 12 and the sorter 14.

SYSTEM APPARATUS

In FIGS. 2–4B, duplicator apparatus 24 (corresponding to the duplicator 12) and sorter apparatus 26 (corresponding to the sorter 14) for the Xerox 9900/60+ unit are illustrated in greater detail and will be described herein to an extent that facilitates development of an understanding of the present invention.

Accordingly, the duplicator apparatus 24 employs an automatic document handler (ADH) 30 which automatically inverts and feeds an original document onto a platen glass 32 with proper registration against a registration edge. Original documents can also be placed manually on the platen glass.

Four xenon lamps 34 are flashed to illuminate the original document on the platen glass 32. In turn, mirrors 36 and 38 reflect an image of the original document through lenses 40 which transmit a focused image to the surface of a photoreceptor belt 42. Electric charge is applied to the belt 42 by a charge corotron 44.

Brighter areas of the reflected image discharge the underlying areas of the belt 42, while darker image areas of the belt 42 remain charged. Lamps 46 are employed to discharge the belt edge areas and the belt areas between copies to reduce dry ink consumption and to keep the duplicator 24 clean.

Five magnetic rollers 48 brush the belt 42 with a positively charged steel developer which carries negatively charged dry ink. Positively charged areas of the belt 42 attract the negatively charged dry ink to form a dry ink image. A lamp and a corotron 50 loosen the dry ink image for transfer to copy paper.

Copy paper is obtained from one of three sources. Thus, a main tray 52 or an auxiliary tray 54 supplies paper for the copying process. A duplex tray 56 refeeds paper with first-side image for second-side imaging in a duplex mode in which two-sided copies are produced.

The dry ink image is transferred to a sheet of copy paper after the paper is transported over belt 58 and as it passes between a bias transfer roller/transfer corotron 60 and the photoreceptor belt 42. A detack corotron 62 strips the paper from the belt 42 after image transfer. The copy paper next passes through a roller section 66 where a pressure roller applies pressure to the paper and a heat roller melts the dry ink into the copy paper.

A lamp, corotron, and brush 64 clean the photoreceptor belt 42 for the next copy.

When the copy paper reaches a turnaround station 68 in the simplex mode, the paper is transported over path 70 for delivery to the sorter 26. In the first pass in the duplex mode, the paper is inverted into the station 68 and then is returned over path 72 to the duplex tray 56 for a second pass in which the second paper side is imprinted with the second side image. After the second pass in the duplex mode, the paper is sent from the station 68 over the path 70 to the sorter 26.

A xerographic maintenance module 74 is used by the operator or a service representative to adjust xerographic voltages and currents to specifications.

Figure 3:
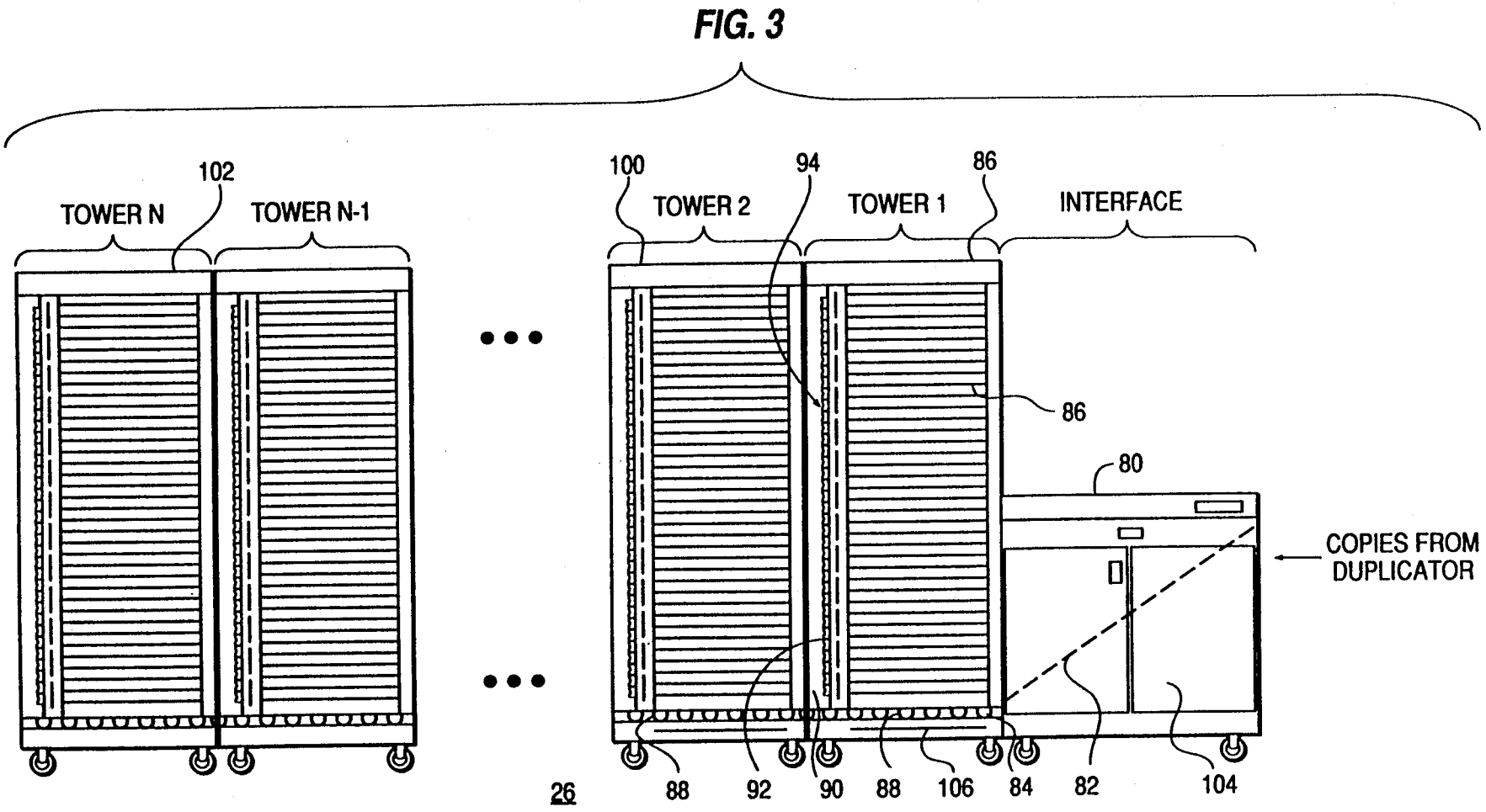
FIG. 3 is an elevational view of a sorter included in the copy system of FIG. 1.

As shown in FIG. 3, copy sheets are delivered along the sorter paper path from the duplicator 24 to an interface module 80 between the duplicator 24 and the sorter 26. In the module 80, sheets proceed down an incline transport 82 to an entry level 84 for a first sorter tower 86.

Figure 4A:
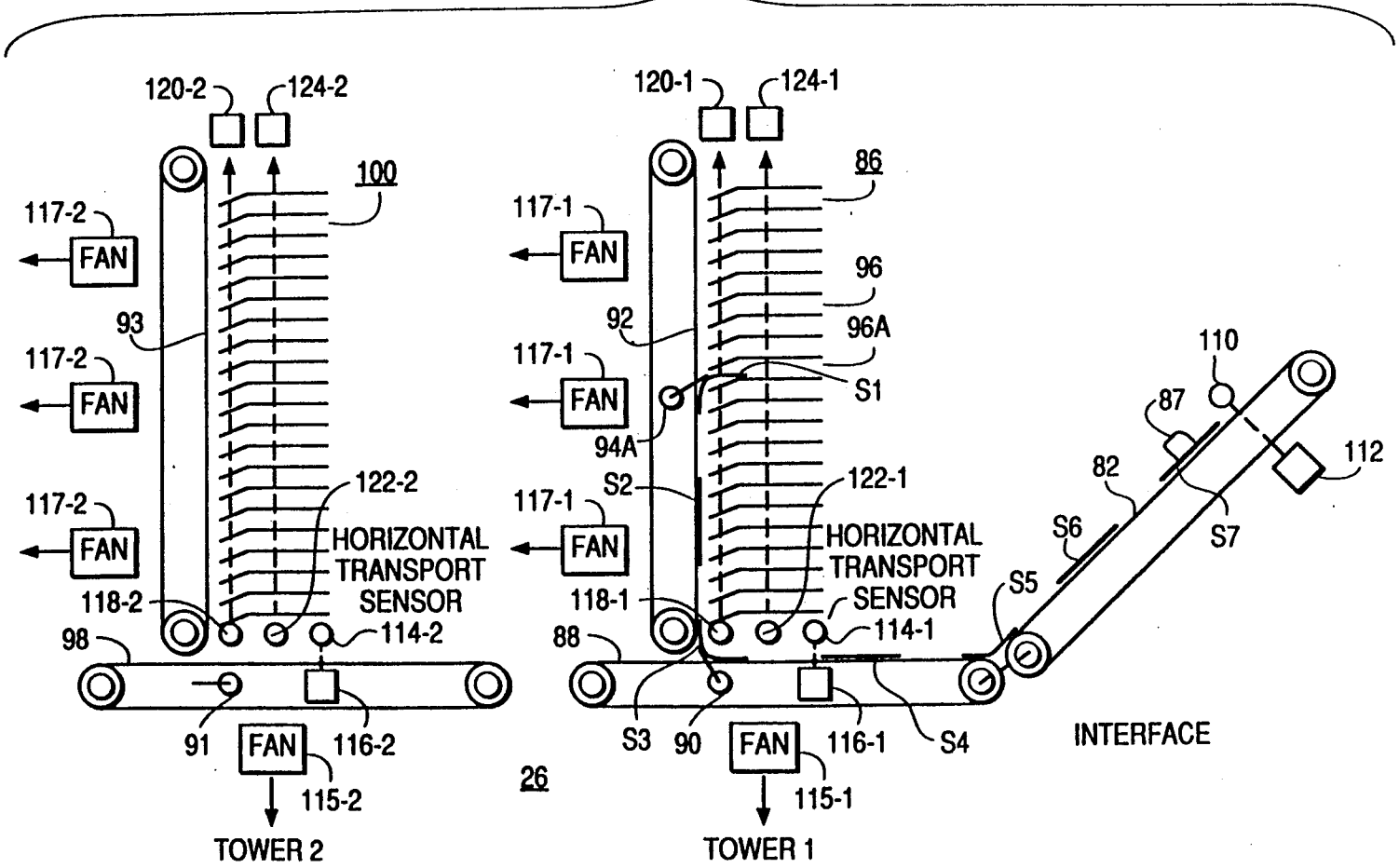
FIG. 4A shows an enlarged, generally schematic view of towers in the sorter of FIG. 3 along with interface apparatus connected between the duplicator and the sorter.
Figure 4B:
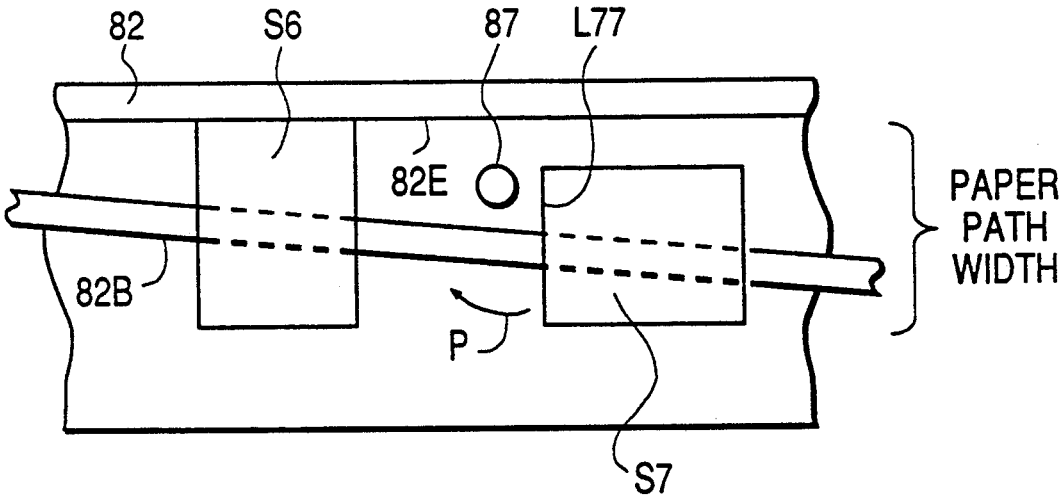
FIG. 4B is a partial top plan view of an incline transport employed in the interface apparatus of FIG. 4A.

As indicated in FIGS. 4A and 4B, a pivoting force P is applied to each copy sheet just after entry to the incline 82 by rotator means such as a spinner device 87.

The spinner 87 is mounted (FIG. 4A) inboard of the paper path and off-center in relation to a leading long dimension edge LE7 of sheet S7 and projects upwardly (FIG. 4A) beyond the plane of an incline ball-on-belt system 82B thereby acting as an obstacle to the sheet S7 and imposing the pivoting force P against the leading edge of the sheet S7.

The sheet S7 thus pivots in its plane so that the long sheet edge LE7 moves toward alignment with a metallic registration edge 82E along the length of the incline. The ball-on-belt system 82B is skewed toward the registration edge 82E thereby quickly directing the pivoting sheet S7 into registration with the registration edge 82E as the sheet S7 continues downwardly inclined movement on the incline transport 82. The weight of distributed balls (not shown) holds the sheet against an underlying skewed belt (not shown) thereby providing added continuing registration force on the sheet S7. Sheet S6 is ahead of the sheet S7 and is shown as having its long edge LE7 registered against the incline edge 82E and thus properly oriented for entry to the sorter 14.

A horizontal transport 88 delivers each sheet to a vertical deflector gate 90 which, if actuated, deflects the sheet to a vertical transport 92 for upward travel in the first tower 86. When the sheet encounters an actuated bin deflector 94A, the sheet is deflected horizontally into the associated bin 96.

If the vertical deflector gate 90 is deactuated when a sheet reaches it, the sheet continues over a horizontal transport 98 in a second tower 100 and like horizontal transports in each successive tower until a tower with an actuated vertical deflector gate like the gate 90 is encountered. The sheet is then deflected upwardly in that tower for routing to the selected bin. An overflow catch tray (not shown) is provided at the output of an Nth tower 102 if no vertical deflector gate in any of the sorter towers is actuated.

In FIG. 4A, the first two towers 86 and 100 of the sorter 26 are shown in somewhat greater detail. The interface incline transport 82 includes an interface paper path sensor preferably in the form of an optical pair that includes an LED device 110 and an optical sensor 112. Paper sheets such as the sheets S6 and S7 are held, as previously described, against the incline belt surface and properly oriented by the bell-on-belt system 82B.

As a sheet such as sheet S5 is transferred to the horizontal belt system 88 for the first tower 86, it is held against the horizontal belt surface in proper position by a pressure differential produced across the horizontal belt by fan means 115-1. Another paper sensor preferably in the form of an optical pair 114- 1 and 116-1 operates as a horizontal paper transport sensor in the tower 86.

When a sheet such as sheet S3 reaches the vertical deflector 90 in its actuated position, the sheet S3 is deflected upwardly in the first tower 86 and transferred to the vertical belt system 93. A sheet such as sheet S2 is held in proper position against the vertical belt surface by a pressure differential produced across the vertical belt by fan means 117-1 three fans in the preferred embodiment.

The vertical transport belt 92 drives each sheet upwardly until an actuated bin deflector such as deflector 94A is encountered. The sheet such as sheet S1 is then directed into the associated bin, i.e. bin 96A.

An optical pair sensor 118-1, 120-1 is employed in the tower 86 to detect paper entry into a bin. Another optical pair 122-1,124-1 generates a signal when the tower 86 is empty.

Other towers in the sorter 26 include optical sensor pairs, deflectors, transport belts, and fans like those described for the tower 86. A vertical deflector 91 in the second tower 100 is shown in the unactuated position. Other elements like those in the first tower 86 are designated by reference characters corresponding to the reference characters used for the same elements in the first tower 86.

When a copy job is started, sorting system status data is sent to the copy engine control system 18 (FIG. 1). Specifics of how sorting is to be done, in terms of bin sequencing, tower selection and operating mode, are established in the copy engine of duplicating control system 18. The specifics including job parameters, sorter start and stop commands, and handling instructions for delivered copies, are communicated to the sorter control system 20.

In the preferred embodiment, the sorter control 20 is located on a system control board in the interface module 80 as indicated by the reference character 104. A common cable (not shown) connects the system control board 104 to a tower logic board in each tower. Only one tower logic board 106 is shown in FIG. 3. As more fully explained subsequently herein in the general and detailed description of the control system 16, the sorter and tower controls monitor and operate electrical devices in the towers to achieve sorter and copy system performance in accordance with the present invention.

In implementing the present invention in the preferred embodiment, the following information is sent from the copy engine or duplicator control 18 to the sorter control 20:

Command: "Sorter Run"
  Instructs the sorting system to turn on drive systems as required.
Command: "Sorter Stop"
  Instructs the sorting system to turn off all drive systems.
Data: "Specify Job"
  Describes all attributes of the job to the sorting system
Command: "Initialize Sequence"
  Instructs the sorting system to start at the first bin the job will use.

Sorter status data includes number of towers, identity of any off-line towers, available bins, and empty status of each bin. The duplicator control system 18 includes job segment size and other job parameters from sorter status data and job options selected by the operator.

Command: "Request Available Towers and Bins"
  Asks the sorting system to send a message that indicates what resources are available.
Command: "Request Required Towers and Bins for Distribution Job"
  Asks the sorting system to send a message that indicates resources required for Distribution job.

The following information is preferably sent from the sorter control 20 to the copy engine or duplicator control 18:

Data: "Towers and Bins Available"
  Describes what tower and bin resources are available, indicates empty and offline status.
Data: "Required Towers and Bins for Distribution Job"
  Describes what tower and bin resources are required for a Distribution Job.

Data: "Copy Sorted"
Indicates that a copy has entered a bin, used for job integrity control
Data: "Sorting System Jam"
Indicates that a jam has occurred in the sorting system.
Data: "Sorting Jam Cleared"
Indicates that the current jam has been cleared.
Data: "Sorter Empty Status"
Indicates which towers are empty and which are not.

OVERVIEW OF COPY SYSTEMS CONTROL

With reference again to the copy control system 16 in FIG. 1, an operator interface control 140 is provided for the copy engine or duplicator control system 18. A keypad 142 enables an operator to enter job setup and other data. Job status and other data are shown on a display 144.

Figures 1, 5A:
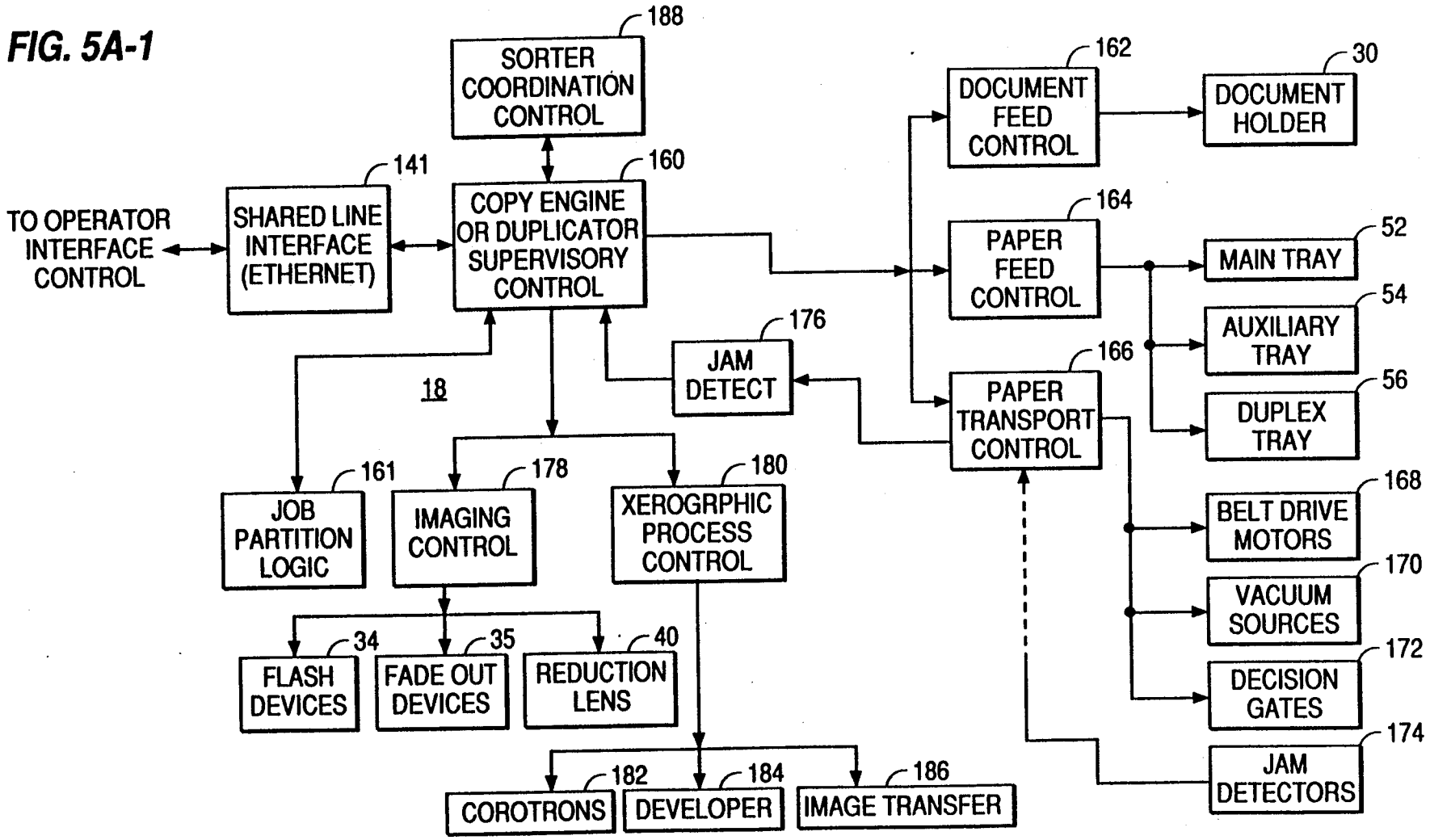
Figures 2, 5A:
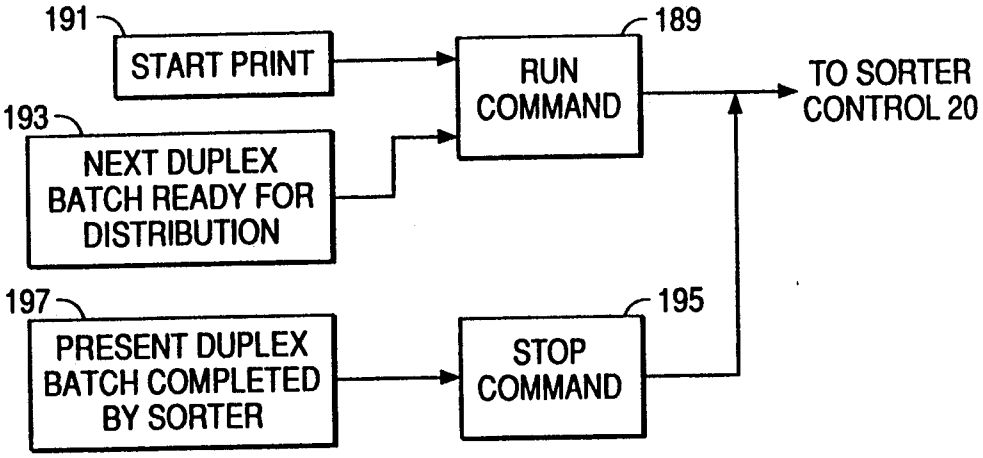
Figure 5B:
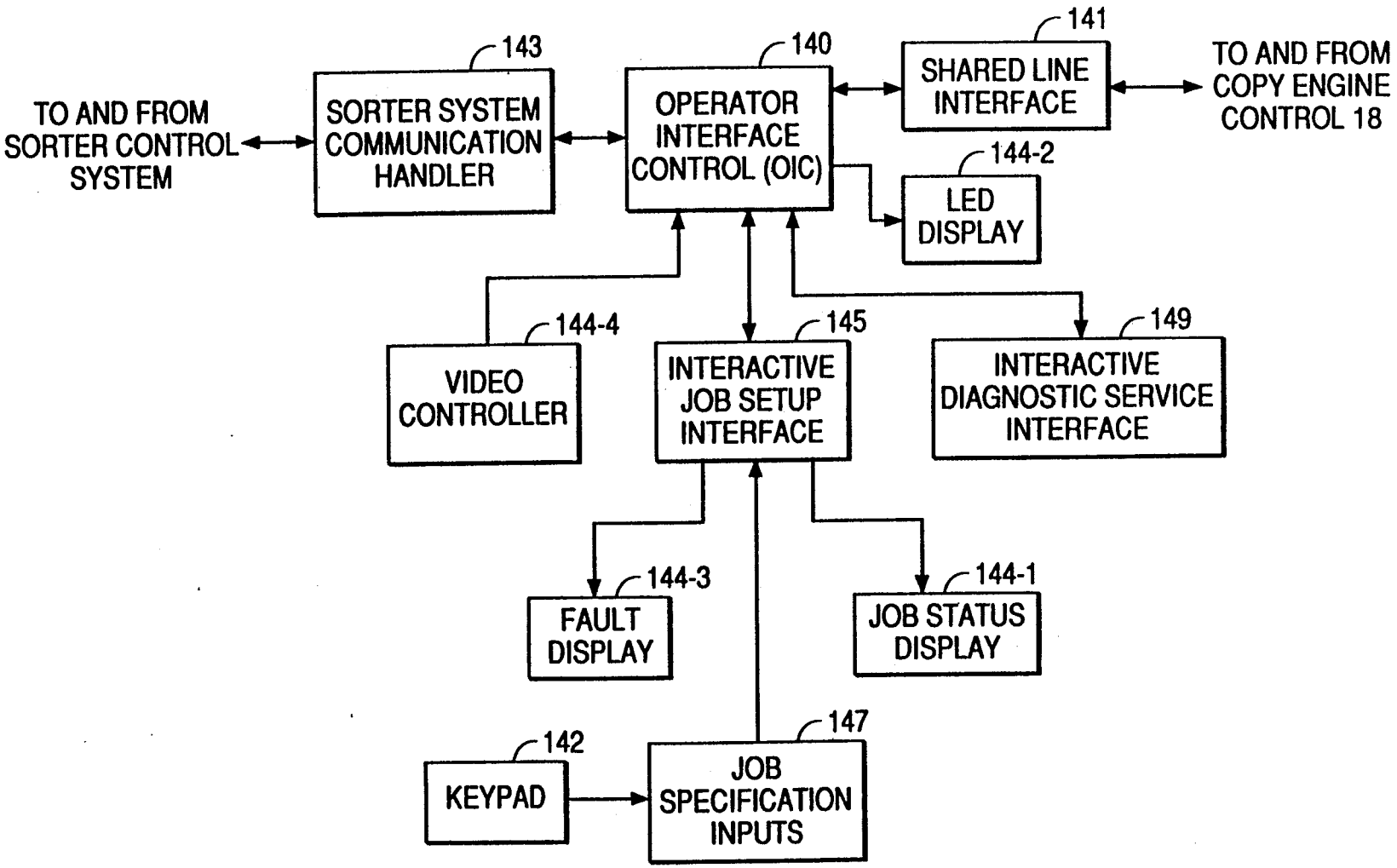
FIG. 5B is a more detailed functional block diagram for an operator interface control employed in the duplicator control of FIG. 5A1.

The operator interface control (OIC) 140 is illustrated in greater detail in FIG. 5B. An OIC screen includes display 144-1 which shows the status of a running job and display 144-3 which shows any faults that occur during the running mode. A video controller 144-4 controls the writing of information on the OIC screen. LED display 144-2 shows the copy quantity and other data.

In the operating mode, interactive job setup software 145 is provided as part of the OIC 140 to process job specification inputs 147 entered by the operator through the keypad 142. A sorter system communication handler 143 handles command and data transmissions to and from the sorter control system 20 after a job setup is completed and the job is started. When the copy system 10 is placed in a diagnostic mode, interactive diagnostic service software 149 is provided to process diagnostic inputs entered by a technical representative in the process of running diagnostics on the system.

Job selection parameters entered by the operator are processed by the OIC 140 for use during software execution in the control and coordination of the copying and sorting processes. Job selection parameters include:

Copy Quantity
Mode—1 side to 1 side, 1 side to 2 sides, 2 sides to 1 side, 2 sides to 2 sides
Output—top tray, uncollated sorter, collated sorter, collated supplement, special distribution
Starting Bin
Starting Tower
Number of Bins Per Set
Capacity of Bins—collated mode
Capacity of Bins—uncollated mode
Bin Skip Mode
Towers in Limitless Sorting After First Pass—single, multiple Once a copy job has been entered into the copy system 10 and original documents are placed in the original document holder 30 (FIG. 2), the copy engine or duplicator control 18 (FIG. 1) operates the copy engine 12 or duplicator 24 (FIG. 2) through control devices 146 and executes the programmed job. The sorter control 20 is coordinated to operate the sorter 14 in accordance with the job requirements and in accordance with the present invention as more fully described hereinafter.

Sorter coordination is achieved through the transmission of commands and data from the duplicator control 18 through the OIC 140 and sorter communication interface 22 to the sorter control 20. Data is also sent from the sorter control 20 through the sorter communication interface 22 and the OIC 140 to the duplicator control 18 to facilitate coordinated system operation. The transmitted commands and data are preferably those described previously herein for the preferred embodiment.

As indicated by reference character 148 (FIG. 1), copy sheets are transported from the duplicator output to the transport interface 80 which is operated by control devices 150 under the control of the sorter control system 20. The copy sheets are then transported to the towers 86, 100, 102, etc. as indicated by reference character 152 and as described in connection with FIG. 3.

A tower control 86C, 100C, 102C, etc. is provided for each tower in the sorter 14. In the Xerox 9900/60+ duplicator, the sorter 14 can include up to 10 towers with each tower having sixty bins.

The sorter control 20, under duplicator control commands, operates through a tower communications interface 154 to direct the tower controls in operating the towers in accordance with the present invention and in accordance with system and programmed job requirements.

Each of the controls at the various control levels preferably include a programmable microcomputer (not specifically shown). In the present embodiment, for example, each of the various controls preferably includes a microprocessor chip as follows:

duplicator control 18—Intel 8085
OIC 140—Intel 8085
sorter control 20—Intel 8088
each tower control—Intel 8051

COPY ENGINE OR DUPLICATOR CONTROL SYSTEM

Figure 2:
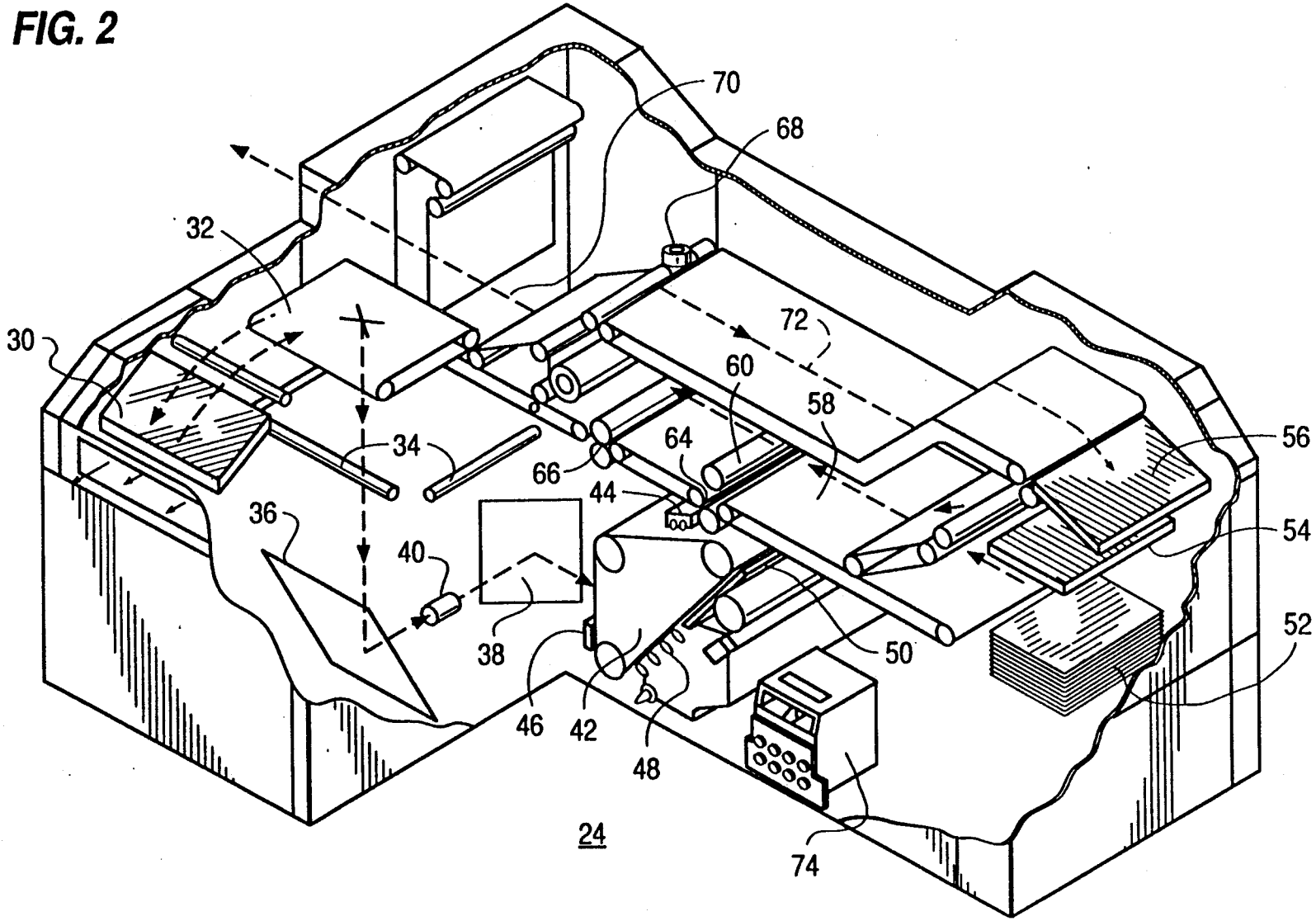
FIG. 2 shows a perspective view of a copy engine or duplicator that is included in the copy system of FIG. 1 and that is partially broken away to show how copies are produced from original documents.

The duplicator control 18 is shown in greater detail in FIG. 5A-1. Generally, the duplicator control 18 directs and coordinates the operation of the duplicator 24 through basic control functions including document and copy paper feed and transport control, image generation control, and image transfer and fusing control (xerographic process control). Various control devices, described in connection with the duplicator apparatus 24 of FIG. 2, are operated under sequencing and logic control by the duplicator control 18 in executing these basic control functions.

Input data defining the current copy job is transferred through the shared line (ethernet) interface 141 to a supervisory control level 160 of the duplicator control 18 from the operator interface control 140. Where a programmed job exceeds the system resources, programmed job partition logic is employed by the duplicator control 18 to divide the job into sub-jobs which individually are appropriate to the system resources and which taken together constitute the programmed job. Job factors considered in the partitioning logic include: copy quantity, copy mode (simplex, duplex, etc..), duplex tray capacity, and sorting capacity.

A document feed control 162 operates a document belt drive and other document feed devices to transfer original documents sequentially from the original document holder 30 to the platen glass as successive copy operations are completed. A copy paper feed control 164 similarly operates paper feed devices associated with the operator selected tray 52, 54 or 56.

As successive copy sheets are fed to the copying process, a paper transport control 166 operates various belt motors 168, vacuum sources 170 and decision gates 172 along the paper path as required to execute each copying operation within the duplicator machine 24. Strategically located jam detectors 174 signal the paper transport control 166 if a paper jam occurs. The supervisory control 160 is also signaled as indicated by reference character 176 and then initiates appropriate action.

An imaging control 178 controls the flash units 34, fade out devices 35 and the reduction lens 40 in producing an image on the photoreceptor belt 42. A xerographic process control 180 operates various corotrons 182, developer apparatus 184, and image transfer devices 186.

A sorter coordination control 188 generates SORTER RUN and SORTER STOP commands as inputs to the sorter communications interface 22 in step with the start and end of copy sheet output from the duplicator 24. The sorter coordinator 188 also collects data that describes all attributes of the current job and transmits such data to the sorter control 20. The sorter coordinator 188 further initializes the sorter control 20 to start at the first bin that will be used by the job.

As shown in FIG. 5A-2, a SORTER RUN command 189 is generated in response to entry of a START PRINT signal 191 by the operator or when a NEXT DUPLEX BATCH READY logic signal 193 is generated after a previous duplex batch has been completed by the sorter 14. A STOP command 195 results when the present duplex batch is completed by the sorter 14 as indicated by block 197.

SORTER CONTROL SYSTEM

The sorter control 20 transmits data on towers and bins availability and requirements in response to command requests from the sorter coordinator 188. As listed previously herein, other data transmitted to the sorter coordinator from the sorter control 20 includes jam data, sorter status and copy sorted.

Sorter data is received by the OIC 140 and processed into a data base of sorter status information. The sorter data base is used by the duplicator control system 16 in the execution of control software that controls and coordinates the copying and sorting processes.

The sorter control 20 and associated tower controls are shown in greater detail in FIGS. 6A–6B and 7A–7C. In addition to inputs from the sorter communications interface 22, inputs 190 are applied from a keypad and the interface downramp entry sensor 110, 112 (FIG. 4) to the sorter control 20. An interface control display 193 displays running job data such as the tower bin scheduled to receive the next copy and the number of copies in that bin. In the diagnostic mode, keypad entries are made and the display 193 generates information that results during operation of the interactive diagnostic process.

An interface transport control 194 provides on/off control for the interface transport 82 through a downramp drive motor 196 as a function of signals from the downramp entry sensor 110, 112. Diagnostic logic 198 is employed by the operator or service person to test sorter operation and to resolve fault conditions.

Figure 6B:
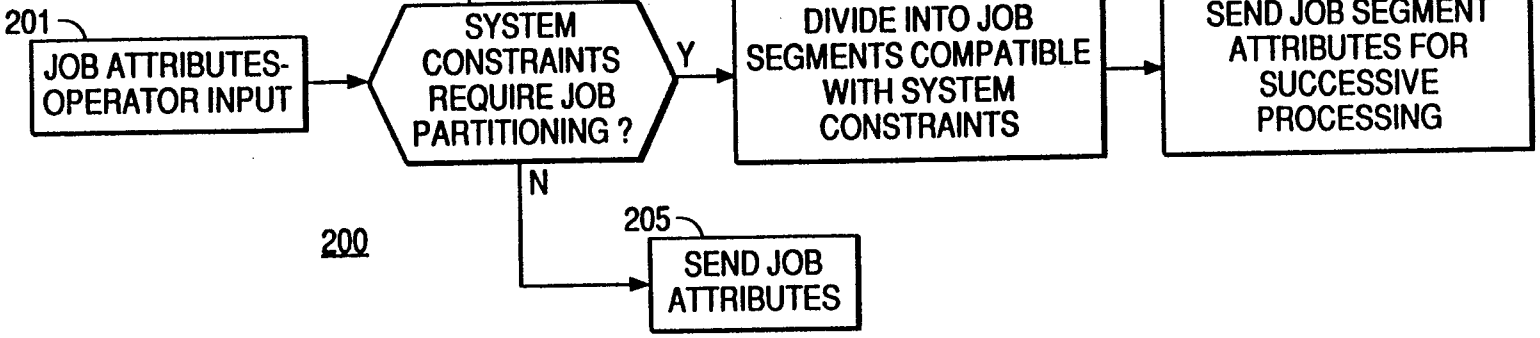
FIG. 6B is a functional block diagram representing programmed processing of copy job attributes in the duplicator and sorter control systems.

A tower allocation logic control 200 is employed by the sorter control 20 to modify commands from the duplicator control 18 and develop respective tower commands that specify requirements for coordinated operation of the towers in distributing output copies from the duplicator 24 and completing the current job. As shown in FIG. 6B, the logic control processes job attributes 201 that have been input by the operator and determines in test block 203 whether system constraints require the specified job to be divided into sub-jobs. If not, block 205 transmits the job attributes for tower processing.

If partitioning is required, block 205 divides the job into job segments each of which is compatible with system constraints. The attributes for the computed job segments are sent to the tower controls one-by-one until the job segments are successively completed, at which time the whole job as specified by the operator is completed.

Figure 6A:
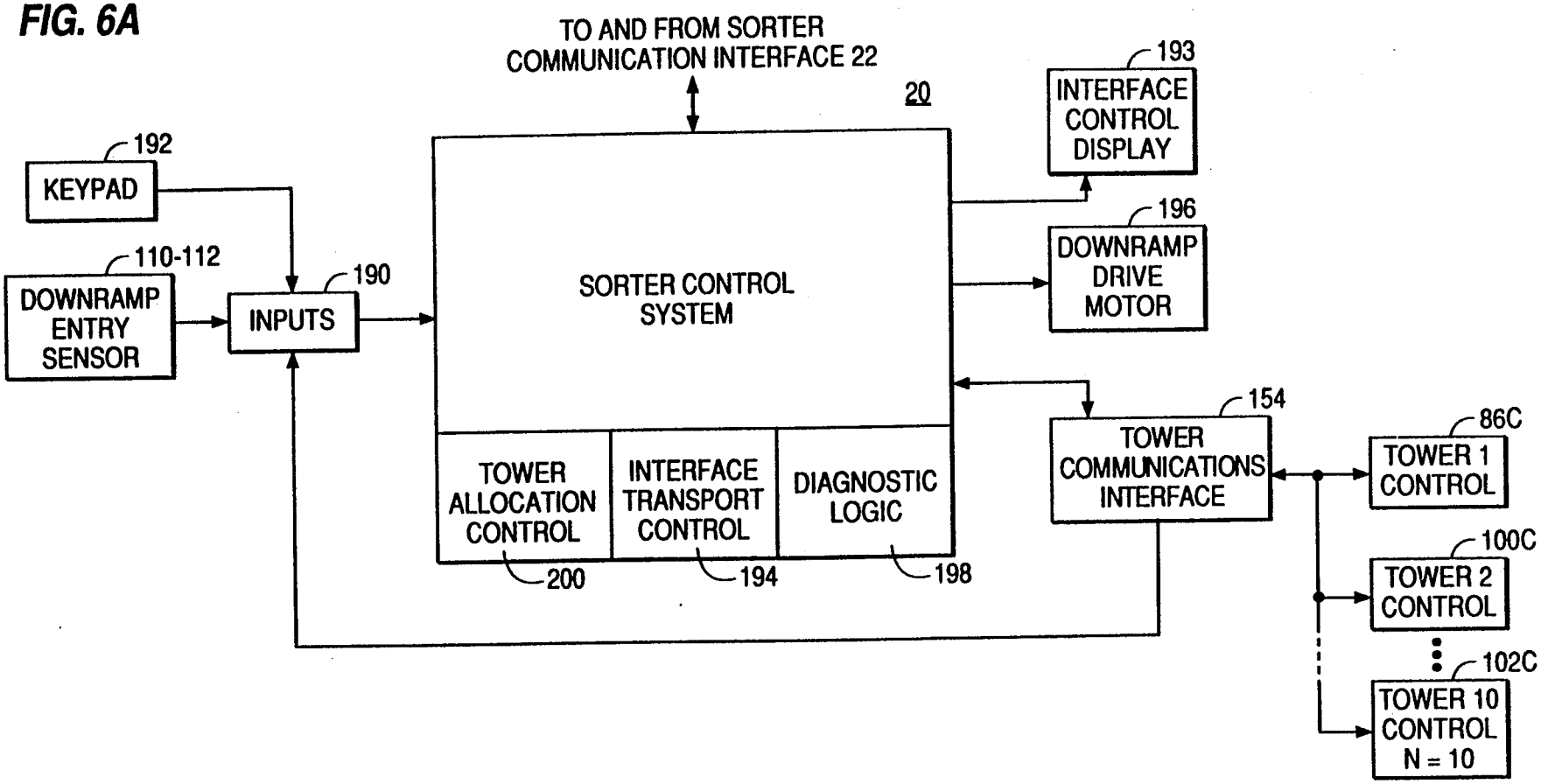
FIG. 6A shows a functional block diagram of a control system for the sorter of FIG. 3.

Tower commands are transmitted to the respective tower controls 86C, 100C, 102C, etc. through the tower communications interface 154. As a specific example, the Nth tower control in FIG. 6A is designated as the tenth tower control which corresponds to the maximum number (10) of towers that the Xerox 9900/60+ can currently accommodate. Tower controls 3 through 9 are not shown in FIG. 6 since they are like the illustrated tower controls.

Figure 7A:
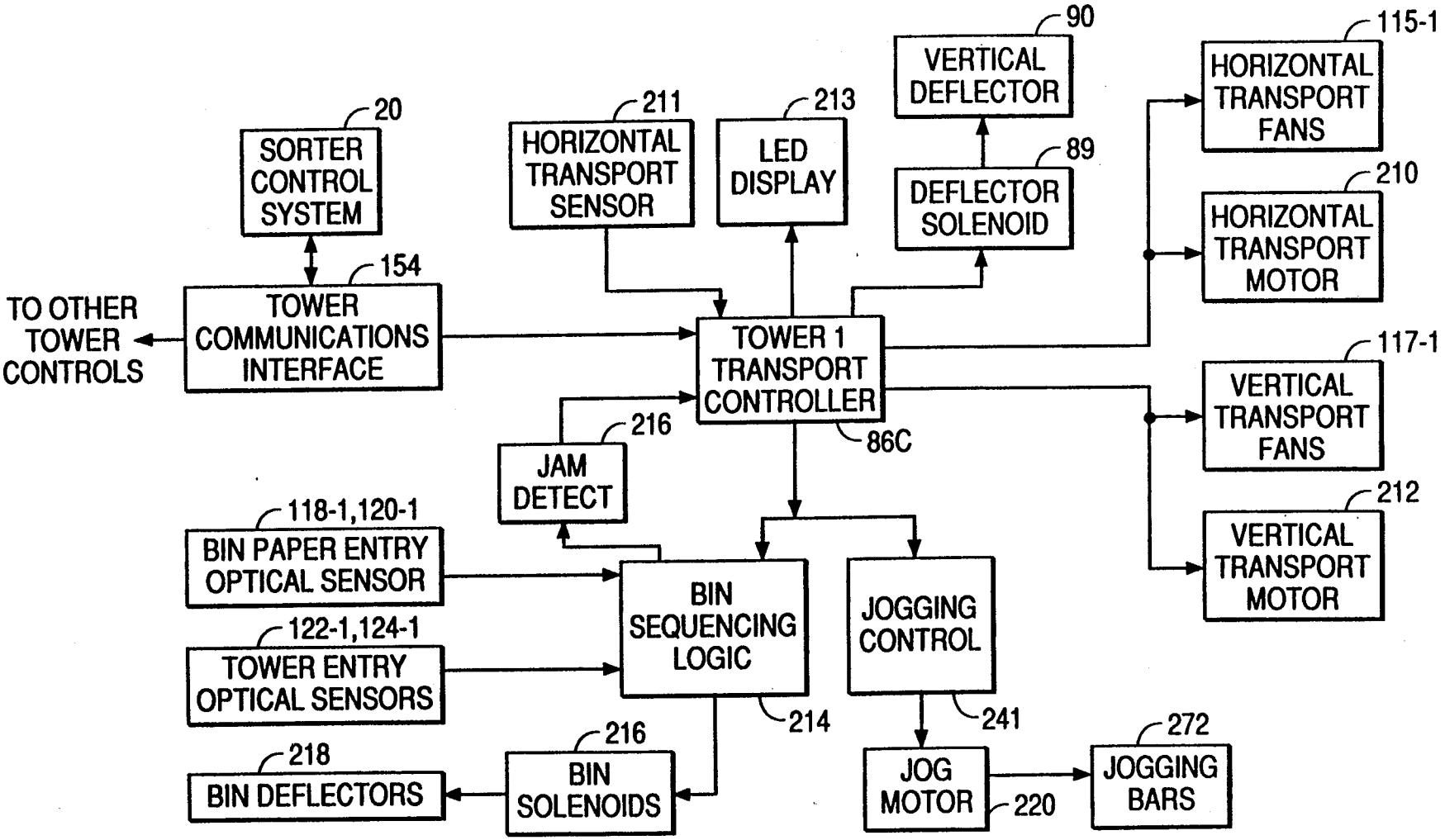
FIG. 7A shows a functional block diagram of a control system that is provided for each tower in the sorter.

More detail is shown for the tower control 86C in FIG. 7A. Other tower controls have like detailed structural content.

Commands for the tower control 86C from the sorter control 20 specify tower start/stop, tower sequencing based on copies to be delivered to each bin. It is also preferred that a START signal for the horizontal transport for the next available tower, such as the tower 100, be sent to the control for that tower so that it is ready in the event paper flow is diverted from the tower 86.

Figure 7B:
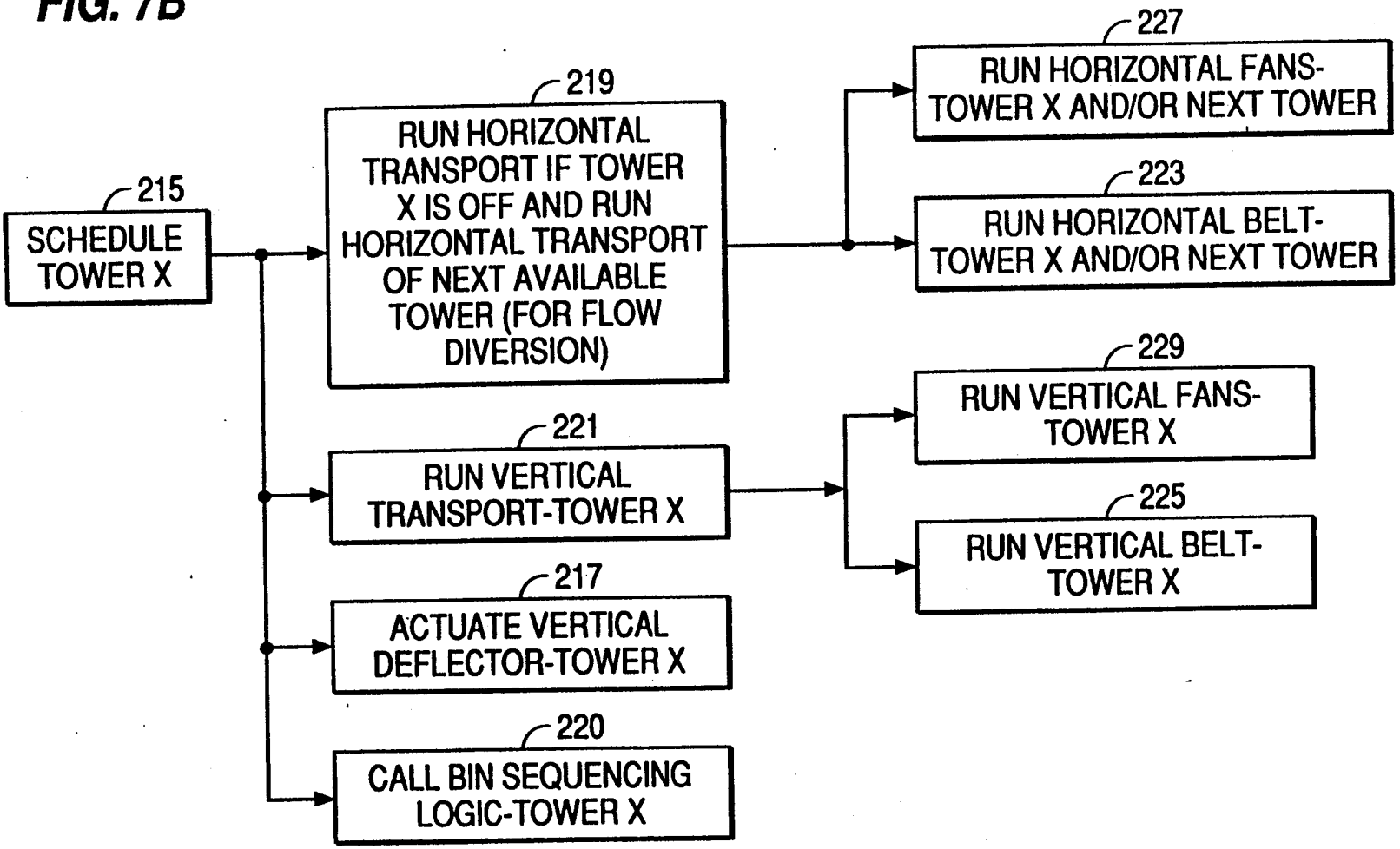
FIG. 7B illustrates programming employed in the tower control to operate the tower mechanical devices.

Reference is now made to FIG. 7B as well as FIG. 7A. If a tower X, such as the tower 86, is to receive copies as indicated by block 215, block 217 actuates a solenoid 89 to operate the associated vertical deflector 90. Blocks 219 and 221 start the associated horizontal and vertical belt motors 210 and 212 under direction from blocks 223 and 225 and the single horizontal fan 115-1 and the three vertical fans 117-1 are started under direction from blocks 227 and 229. In addition, the horizontal transport for the next available tower is started by the block 223 as previously indicated.

After the bin sequence for the tower 86 is completed, the vertical transport 92 (FIG. 4) is turned off and the associated vertical deflector is deactuated. Since subsequent sheets are to pass through the tower 86 to the next available tower such as the tower 100, the horizontal belt motor 210 for the horizontal transport 88 and the horizontal fan 114-1 are kept running. A horizontal transport sensor signals the horizontal transport status to the tower control 86C. LED displays 213 indicate when the tower is empty and when a paper jam has occurred in its operation.

The bin sequence is controlled by bin sequencing logic 214 which actuates bin solenoids 216 to operate bin deflectors for successive bins in accordance with the scheduled bin sequence. Copy sheets transmitted in a copy sheet stream from the duplicator 24 are thereby distributed in the sorter 14 in accordance with commands and attributes received from the sorter control system 20 with feedback regulation provided by signals from the bin entry sensors 118-1, 120-1.

Additional bin status data is supplied to the bin sequencing logic 214 by the tower empty sensor 122-1, 124-1. Such data is provided for LE display and transmitted to the duplicator OIC 140 for its status data base.

Any jam detected by jam detection logic 217 on the basis of feedback signals from bin and tower entry sensors is transmitted to the tower control 86C for appropriate action, such as a sorter shutdown followed by a job redefinition for restart after the jam is cleared.

Figure 7C:
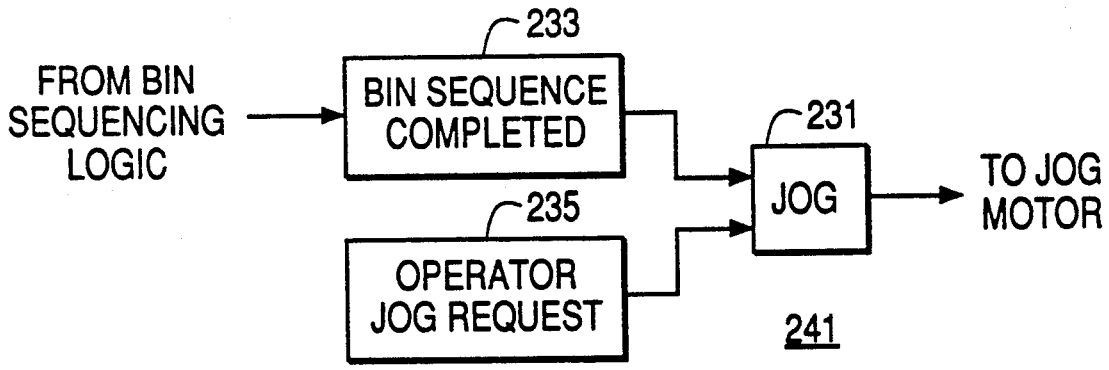
FIG. 7C shows program logic employed to control paper jogging bars in the towers.
Figure 7D:
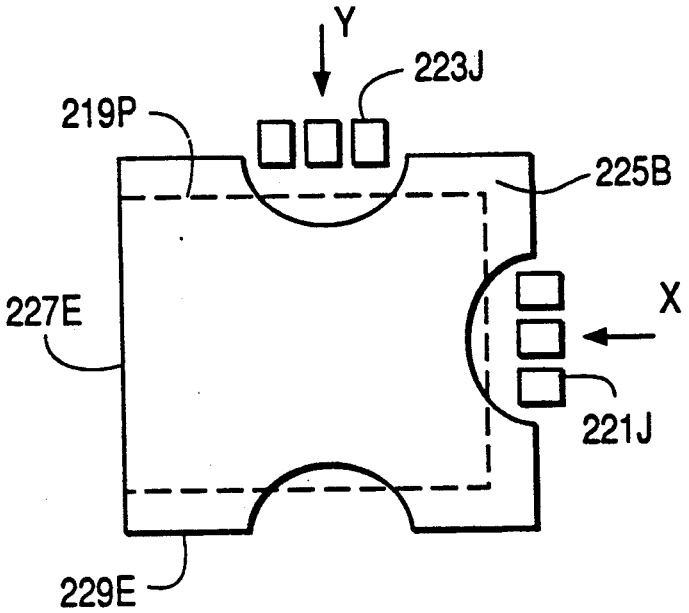
FIG. 7D is a schematic top plan view of the base of a tower bin along with jogging bars employed to push paper copies into an aligned stack within the bin.

A jogging control 241 operates a tower jog motor 220 to drive jog bars 221J and 223J (FIG. 7D) along X and Y axes to shuffle sheets into alignment in each bin in a tower such as the tower 86. A sheet of paper 219P delivered to a bin and located on bin base 225B is pushed against bin edges 227E and 229E by the jog bars 221J and 223J and thus aligned with previously jogged underlying sheets. As shown in FIG. 7C, such jogging is programmed in block 231 to occur when block 233 indicates completion of the bin sequence for the tower or when block 235 signals an operator initiated jog, and when copies are being distributed to another tower.

COPY SYSTEM OPERATION IN THE COLLATED, DUPLEX MODE CHARACTERIZED WITH BOTH COPY RELIABILITY AND EFFICIENT COPY DISTRIBUTION

The copy system 16 (FIG. 1) operates in the collated duplex mode when the operator enters the collated and duplex mode selections through the operator interface control 140. In the preferred embodiment, the capacity of the duplex tray 56 is 100, the number of towers in the sorter 20 is 10, and the number of bins in each tower is 60.

The number of documents in the set of originals to be copied corresponds to the number of copies in each collated copy set in the sorter 20. In turn, the number of copies per collated copy set determines the number of bins required for delivery of each copy set. As indicated previously, it is desirable to schedule the production and distribution of copies in the collated duplex mode so that a reasonable balance is automatically achieved in copy reliability, system operating efficiency and operator efficiency (through facilitated unloading) essentially independently of the size of the entered job.

In accordance with the present invention, the copy system 10 is preferably operated in the collated duplex mode to schedule single tower loading of copy sets when the number of bins allocated per set is sufficiently low to provide acceptable copy reliability, system operating efficiency, and operator unloading facility. At the very least, single tower loading is scheduled if a single bin is allocated per copy set. Multiple tower loading is scheduled when the number of bins allocated per set is sufficiently high to result in an unacceptable imbalance of copy reliability, system operating efficiency, and operator unloading facility with single tower loading. Some loss of operator unloading facility is incurred with multiple tower loading but the gain in machine efficiency is more than offsetting.

Figure 8C:
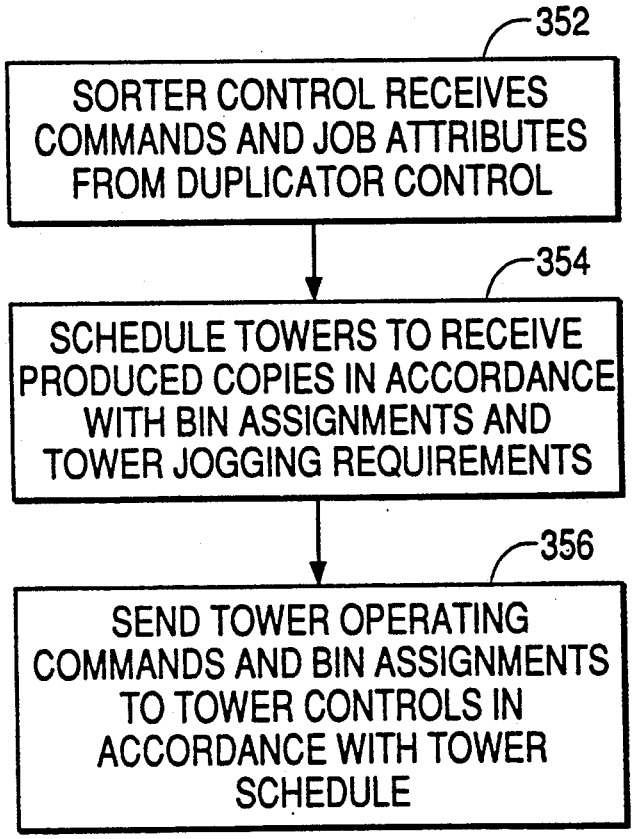
FIG. 8C shows a flow chart representing the operation of the sorter control in implementing tower and bin assignments for output copies under direction of the duplicator control.
Figure 8A:
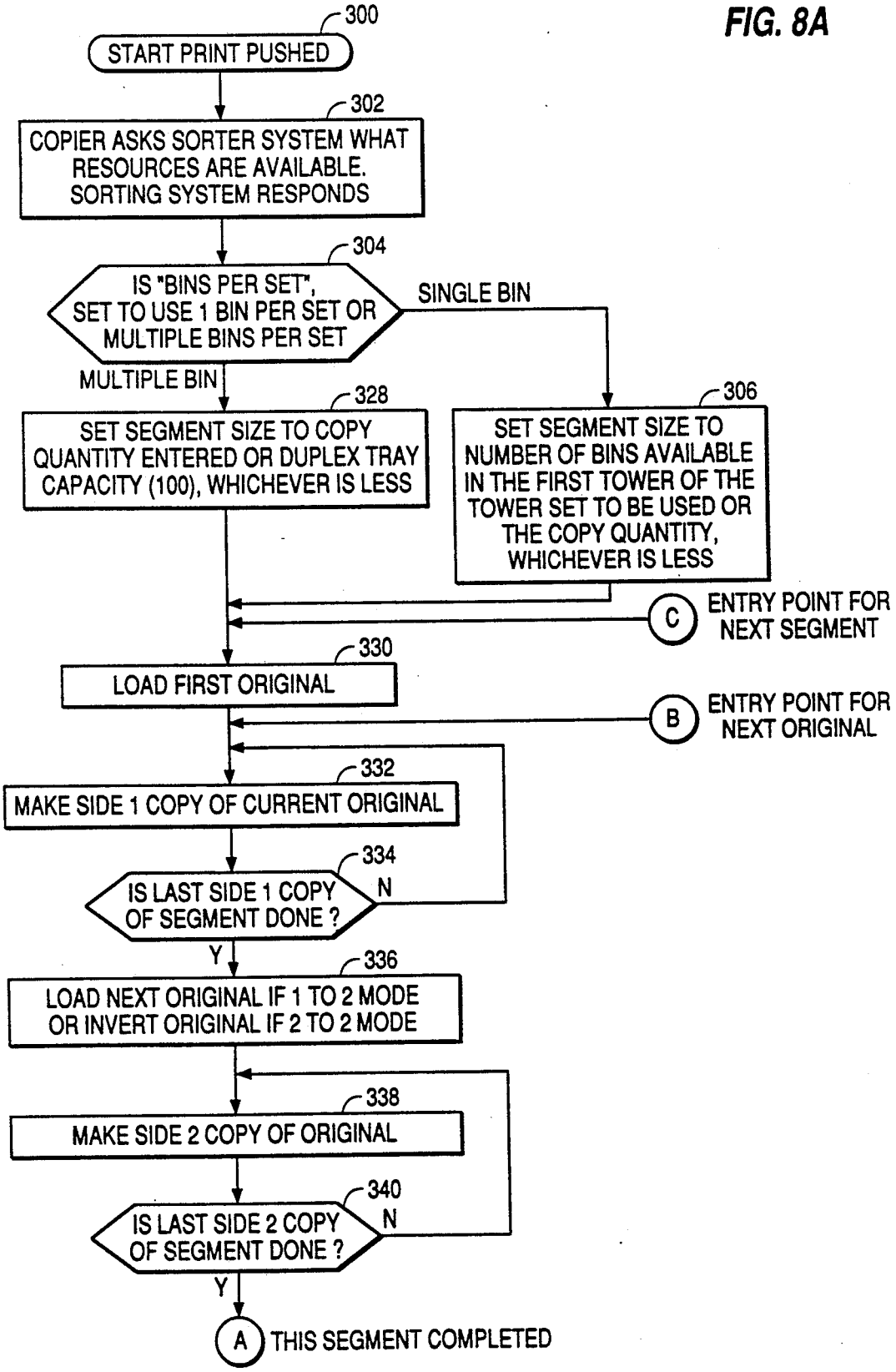
FIGS. 8A and 8B show a flow chart that represents the manner in which the duplicator is controlled in the collated duplex mode to enable the copy system to produce better sorting in high-volume copy work in accordance with the present invention.
Figure 8B:
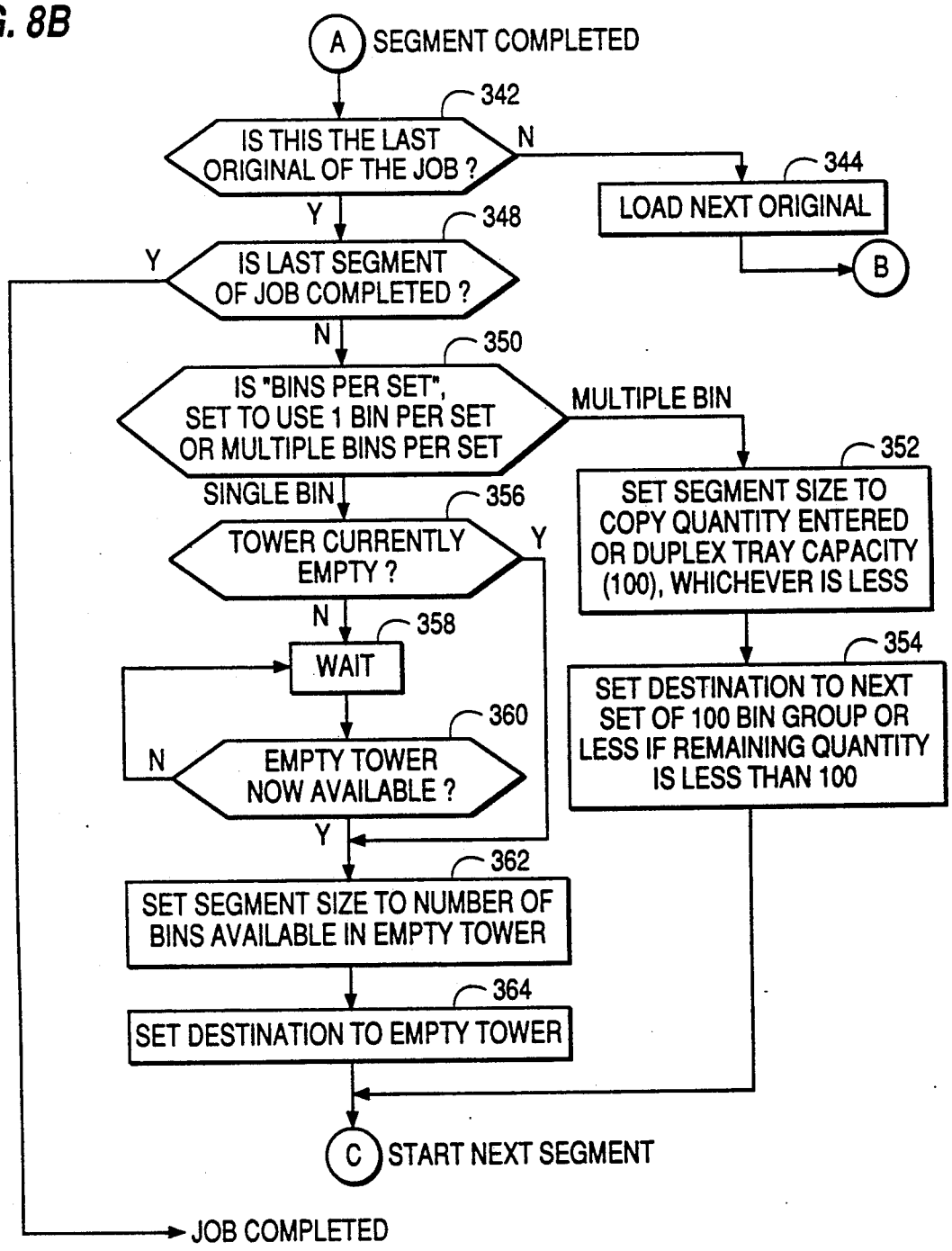

In FIGS. 8A and 8B, a flow chart specifically illustrates the operation of the copy system control 16 in the collated duplex mode in accordance with the present invention. With the copy engine (FIG. 1) or the duplicator 24 (FIG. 2) and the sorter 14 or 26 started and the job copy quantity entered, the duplicator control 160 responds to a signal from the start print button as indicated by the reference character 300 to execute block 302 which requests the sorter control system 20 to send available sorting resources. The sorter control 20 sends status data including number of towers available, identity of off-line towers, bins available and empty status of each bin. The sorter data is stored in a data base in the duplicator control 160.

Next, test block 304 determines the setting of a selector BINS PER SET. If single-bin operation has been selected, block 306 sets the job segment size to the number of bins available in the first tower of the tower set to be used or the requested copy quantity whichever is less. In this manner, single tower loading is scheduled to facilitate operator unloading of the sorter 14 or 26 while a relatively high duplex tray utilization (60% utilization for 100% tower bin availability) is provided with good system efficiency and good copy reliability.

If a multiple bin setting has been made because the number of originals to be copied to form an output set or book exceeds the capacity of a single bin, block 328 sets the segment size to the copy quantity entered or the duplex tray capacity whichever is less. Further, it is preferred that multiple bin jobs be limited to the sorter capacity thereby excluding limitless operation.

Thus, multiple tower loading is scheduled for multiple bin jobs to maximize duplex tray utilization, system efficiency and copy reliability while sacrificing some operator unloading facility. However, with multiple tower loading for multiple bin jobs, overall system operation is improved on balance.

After the block 328 or 306 is executed, the copy system is ready to execute the copying process. The first original is loaded by the document handler as indicated by block 330 and side one copy of the original is made as indicated by block 332 and sent to the duplex tray 56. Test block 34 directs additional copies to be made of the current original until the required number for the set segment size are made.

Block 336 then loads the next original if the 1-to-2 mode has been selected, or the current original is inverted if the 2-to-2 mode has been selected. Side two copy of the original is next made on side 2 of a sheet received from the duplex tray 56 and then sent to the sorter 14 as indicated by functional block 338.

Test block 340 directs repeat operation of block 338 to make side two copies on successive sheets from the duplex tray 56 and send such sheets to the sorter 14. When the last side two copy of the segment is made for the current original, test block 342 determines whether the last original of the job has just been processed.

If not, functional block 344 loads the next original and the copying process is repeated for the next original as indicated by flow chart linker B. When the last original is completed, test block 348 checks whether the last segment of the job has been completed. If so, the job is completed.

If not, test block determines the setting of BINS PER SET. If multiple bin operation (with multiple tower loading) has been selected, block 352 sets the segment size to the copy quantity entered or the duplex tray capacity whichever is less, as explained in connection with the block 328. The destination of the next job segment is then set and downloaded to the sorter control for the next set of 100 bin group or less if the remaining quantity is less than 100. As indicated by flow chart linker C, the program next returns to the block 330 to repeat the copy and multiple tower distribution process for the next job segment.

If single bin operation (with single tower loading) has been selected, test block 356 determines whether the next scheduled tower is empty to verify that the operator has unloaded the tower if it was previously loaded. The tower empty sensor supplies the sorter data needed by the test block 356

If the next tower is not empty, block 358 implements a wait period of predetermined time length and test block 360 makes a tower empty retest. When the tower is determined to be empty, functional block 362 sets the segment size to the number of available bins in the empty tower. The job segment destination is then set to the empty tower by block 364 and the copying and distribution process is repeated through the flow chart linker C. When the block 348 indicates that the las. job segment has been completed, the job is completed.

Copy distribution in the sorter 14 is directed by the sorter control 20 (FIG. 6A) in accordance with commands and data received from the duplicator control 160 (FIG. 5A-1). As shown in FIG. 8C, commands and job attributes are received by functional block 352 by the sorter control 20 from the duplicator control 160 during programmed operation of the letter.

The sorter control 20 employs received data to schedule towers to receive produced copies in accordance with bin assignments and tower jogging requirements as indicated by block 354. Functional block 346 sends tower operating commands and bin assignments to the tower control 86C, 100C, et. (FIGS. 1 AND 7A) in accordance with the tower schedule developed by the sorter control 20.

In turn, the each tower control operates the associated tower as previously described in connection with FIG. 7A. After the tower is sequenced into operation, the bin sequencing logic 214 executes the bin delivery assignment schedule as output copies are received. As previously indicated, the jogging control 241 goes into operation for one tower when delivery of copies is switched to the paired tower.

In summary of the preferred embodiment of a high-volume duplicator system, tower and bin operations are scheduled to provide an advantageous balance of copy reliability, system efficiency and operator unloading facility regardless of job segment size resulting from the requested copy quantity. Basically, single tower loading is employed if a single bin has been selected for each copy set. Multiple tower loading is employed for a multiple-bins-per-set selection.

The foregoing description of the preferred embodiment of the invention has been presented to illustrate the invention. It is not intended to be exhaustive or to limit the invention to the precise form disclosed, and modifications and variations are possible in light of the disclosure herein or may be developed from practice of the invention. The embodiment was chosen and described to explain the principles of the invention and its practical application and to enable one skilled in the art to use the invention in various embodiments and with various modifications as are suited to the particular use contemplated. It is intended that the scope of the invention be defined by the claims appended hereto, and their equivalents.

What is claimed is:

1. A copy system comprising:

means for duplicating successive original documents;

said duplicating means having a limited capacity duplex tray for supporting copy processing in the duplex mode;

means for sorting output copies delivered from said duplicating means;

said sorting means having a plurality of towers each of which has a plurality of bins;

means for transporting output copies to each of said towers;

means for directing output copies in each tower to each bin therein;

means for controlling said duplicating means and said transporting said directing means for said towers and said bins in the collated duplex mode;

said controlling means including means for allocating a number of bins for the accumulation of each collated set;

said controlling means further including means for operating said towers in a single tower loading mode if the number of bins for each collated set is equal to or less than a predetermined number; and said controlling means additionally including means for operating said towers in a multiple tower loading mode if the number of bins for each collated set is greater than the predetermined number.

2. The copy system of claim 1 wherein the number of bin sets assigned for each job segment in the single tower loading mode is the number of available bins in a scheduled tower or a requested copy quantity whichever is less and wherein the number of bin sets assigned for each job segment in the multiple tower loading mode is equal to the duplex tray capacity or the requested copy quantity whichever is less.

3. The copy system of claim 1 wherein the predetermined number is one.

4. The copy system of claim 2 wherein the predetermined number is one.

5. The copy system of claim 1 wherein the number of bins in each tower is up to at least sixty and the number of towers is up to at least ten and the predetermined number is one.

6. The copy system of claim 2 wherein the number of bins in each tower is up to at least sixty and the number of towers is up to at least ten and the predetermined number is one.

7. The copy system of claim 3 wherein said controlling means further includes means for determining whether a next scheduled tower is empty after each job segment is completed and before the job is completed, and means for holding the copy system against continued operation until the next scheduled tower is empty.

8. A method for operating a copy system comprising:

operating a duplicator to duplicate successive original documents operating a multi-tower sorter to sort output copies delivered from the duplicator into multiple bins in each of the respective towers;

controlling the duplicator and sorter in the collated duplex mode to operate said towers in a single tower loading mode if a determined number of bins for each collated set is equal to or less than a predetermined number; and controlling the duplicator and sorter in the collated duplex mode to operate said towers in a multiple tower loading mode if the number of bins is greater than the predetermined number.

9. The method of claim 8 wherein the number of bin sets assigned for each job segment in the single tower loading mode is the number of available bins in a scheduled tower or a requested copy quantity whichever is less and wherein the number of bin sets assigned for each job segment in the multiple tower loading mode is equal to the duplex tray capacity or the requested copy quantity whichever is less.

10. The method of claim 8 wherein the predetermined number is one.

11. The method of claim 9 wherein the predetermined number is one.

* * * * *